US006488279B1

(12) United States Patent
Fukuda et al.

(10) Patent No.: US 6,488,279 B1
(45) Date of Patent: Dec. 3, 2002

(54) DISCHARGE MECHANISM OF SHEET MATERIAL IN IMAGE FORMING APPARATUS

(75) Inventors: Izumi Fukuda, Fukuoka (JP); Akira Oyama, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 78 days.

(21) Appl. No.: 09/711,969

(22) Filed: Nov. 15, 2000

(30) Foreign Application Priority Data

Nov. 16, 1999 (JP) ..... 11-325108

(51) Int. Cl.[7] ..... B65H 29/20
(52) U.S. Cl. ..... 271/314; 271/272
(58) Field of Search ..... 271/314, 272

(56) References Cited

U.S. PATENT DOCUMENTS 3,847,388 A * 11/1974 Lynch ..... 271/220
4,381,860 A * 5/1983 Silverberg ..... 271/10
4,546,964 A * 10/1985 Linthout ..... 271/250
4,585,226 A * 4/1986 LaBate ..... 198/722
4,589,654 A * 5/1986 Kanoto ..... 271/184
4,988,087 A * 1/1991 Sardano et al. ..... 271/220
5,163,674 A * 11/1992 Parks ..... 101/416.1
5,401,540 A * 3/1995 Miles et al. ..... 118/249
5,549,292 A * 8/1996 Plain ..... 271/291
5,606,357 A * 2/1997 Bekki ..... 271/274
5,743,520 A * 4/1998 Barthold ..... 271/189
6,145,833 A * 11/2000 Rodewald et al. ..... 271/182
6,196,542 B1 * 3/2001 Allmendinger ..... 271/189

FOREIGN PATENT DOCUMENTS

JP 9278147 10/1997
JP 8018740 3/1998

* cited by examiner

*Primary Examiner*—Christopher P. Ellis
*Assistant Examiner*—Richard Ridley
(74) *Attorney, Agent, or Firm*—Stevens, Davis, Miller & Mosher, LLP

(57) ABSTRACT

The invention provides a discharge mechanism of a sheet which can quickly and securely discharge a sheet without deformation. A discharge mechanism is provided at an end of a transfer path and discharging the paper to a tray is constituted by a pair of discharge rollers and a profiling pusher integrally rotating with the discharge roller. A sponge-like body portion and a plurality of projections, integrally formed on a peripheral surface thereof, are formed in the profiling pusher. The protrusion is brought into contact with a surface of the sheet and deformed in a profiling manner so as to allow the sheet to pass therethrough. When the rear end of the sheet leaves the nip, the deformation of the projection is restored and engaged with the rear end of the sheet, thereby forcibly pushing out the sheet.

4 Claims, 7 Drawing Sheets

DISCHARGE MECHANISM OF SHEET MATERIAL IN IMAGE FORMING APPARATUS

BACKGROUND OF THE INVENTION

1. Field of the Invention

The present invention relates to an image forming apparatus such as a scanner or the like which is used for a printer, a copying machine, an electronic filing system or the like, and more particularly to a discharge mechanism of a sheet material structured such that a sheet material such as a printing paper, a manuscript paper or the like can be quickly discharged to a recovering tray.

2. Description of the Prior Art

A scanner for reading a manuscript paper in an electronic filing system is divided broadly into a scanner structured such as to put the manuscript papers on a platen one by one and read an image thereof and a scanner structured such as to automatically supply the manuscript papers and read in series. In recent years, in order to effectively process a lot of documents, the latter automatic paper supply type is mainly used.

The automatic paper supply type scanner is basically structured such that the manuscript papers are picked up one by one from a paper supply tray for mounting the manuscript papers so as to be fed into a scanner main body and the manuscript papers are again discharged to the recovering tray arranged in an outer portion of the main body after being scanned by the image reading portion. Then, a feed roller for rotated for feeding and a guide roller for guiding a forward path are provided in a transfer path of the manuscript papers extending to the recovering tray from the paper supply tray via the image scanning portion. Further, a paper discharge mechanism for forcibly discharging the manuscript papers to the tray side is arranged in a portion corresponding to a terminal end of the transfer path and facing to the recovering tray.

The paper discharge mechanism is constituted by a pair of rollers for nipping upper and lower surfaces of the manuscript paper and is structured such that plural pairs of rollers are arranged in a widthwise direction at an interval. In this structure, any one of a pair of rollers is rotated and another thereof nips the manuscript paper as an idler so as to forcibly discharge the paper.

However, in the structure comprising the paper discharge roller rotated at the terminal end of the transfer path and the idler roller nipping the paper with respect to the paper discharge roller, a rear end of the paper to be discharged is not removed from the nip portion of the roller, so that there is frequently generated a paper jamming. The paper is not removed from the nip portion as mentioned above because the rear end of the paper is balanced in a state of being gripped in the nip between the rollers due to an empty weight of the paper at a time of being discharged upward, for example, as described in Japanese Patent Unexamined Publication No. 9-278147. Then, in addition to the upward paper discharge structure mentioned above, even in a structure of horizontally transferring the paper and discharging the paper in a horizontal direction toward the tray as it is, there is generated a trouble that the rear end of the paper is held by the paper discharge roller portion in the same manner.

With respect to the problems mentioned above, for example, in Japanese Patent Publication No. 8-18740, there is described a paper discharge mechanism which realizes a quick paper discharge. The paper discharge mechanism described in this publication is structured such that projections 52*a* are provided at a fixed circumferential pitch on peripheral surfaces at both ends in an axial direction of a paper discharge roller 52 coaxially arranged in a drive shaft 51, as shown in a schematic view showing a main portion of a prior art in FIG. 7. In this paper discharge mechanism, since a paper P can be discharged with engaging a rear end of the paper P with the projection 52*a* of the paper discharge roller 52, it is said that the mechanism is preferable for discharging the paper P.

However, since the paper P is nipped between the paper discharge roller 52 and the idler roller 53, a deformation D a little expanding upward is generated in the paper P due to protrusion of the projection 52*a* outward from the outer peripheral surface of the paper discharge roller 52. Since the deformation D is generated in a feeding direction of the paper P so as to form a stitch shape, the recovered paper P tends to be injured. Further, when the paper P is worn out so as to generate a small hole and an open seam, the projection 52*a* enters into the hole and open seam, so that there is a case that the paper is widely cut or broken.

As mentioned above, the conventional paper discharge mechanism can not avoid the deformation generating the recess on the paper and tends to injure or break the paper. Further, when the paper discharge roller is close to the image scanning portion, the recess deformation of the paper extends to the scanning area by the image scanning portion, so that an image reading on the manuscript paper is influenced.

In this case, the problems mentioned above are generated in the automatic paper supply type copying machine and the printer in the same manner in addition to the scanner apparatus.

SUMMARY OF THE INVENTION

An object of the present invention is to provide a discharge mechanism of a sheet material such as a paper which can quickly and securely discharge a paper after reading or forming an image to a tray in a recovery side with no deformation.

In accordance with the present invention, there is provided an image forming apparatus comprising:

a transfer path to which a sheet material is supplied;

an image processing apparatus for reading an image from the sheet material or printing an image on the sheet material, the image processing apparatus being arranged in the middle of the transfer path;

a tray arranged in a lower side of a terminal end of the transfer path in series and mounting and recovering the sheet material; and a discharge mechanism for discharging the sheet material to the tray, the discharge mechanism being provided in a terminal end of the transfer path, wherein the discharge mechanism is provided with a pair of discharge rollers arranged in upper and lower portions of a path line of the sheet material so that at least one of them can be driven and nipping the sheet so as to apply a transfer movement, and discharging means operating in such a manner as to interlock with the discharge rollers and forcibly pushing a rear end of the sheet so as to discharge to the tray side.

In accordance with a first aspect of the present invention, there is provided a discharge mechanism of a sheet material in an image forming apparatus comprising:

a transfer path to which a sheet material is supplied;

an image processing apparatus for reading an image from the sheet material or printing an image on the sheet material, the image processing apparatus being arranged in the middle of the transfer path;

a tray arranged in a lower side of a terminal end of the transfer path in series and mounting and recovering the sheet material; and a discharge mechanism for discharging the sheet material to the tray, the discharge mechanism being provided in a terminal end of the transfer path, wherein the discharge mechanism is provided with a pair of discharge rollers arranged in upper and lower portions of a path line of the sheet material so that at least one of them can be driven and nipping the sheet so as to apply a transfer movement, and discharging means operating in such a manner as to interlock with the discharge rollers and forcibly pushing a rear end of the sheet so as to discharge to the tray side. Accordingly, even when the sheet material stops in a state of being nipped between the discharge rollers or in an immediately downstream thereof, the sheet material is forcibly pushed out by the discharging means, so that there can be obtained an effect that the sheet material can be securely discharged to the tray side.

In accordance with a second aspect of the present invention, there is provided a discharge mechanism of a sheet material in an image forming apparatus as recited in the first aspect, wherein the discharging means is a roller-shaped profiling pusher coaxially connected to at least one of the pair of discharge rollers, the profiling pusher is provided with a body portion smaller than an outer diameter of the coaxially connected discharge roller and a protrusion formed on an outer peripheral surface of the body portion so as to have an uniform cross section in an axial direction and having a height crossing the path line, and at least the protrusion is set to be capable of being elastically deformed so as to be deformed in a profiling manner due to a reaction force from the sheet material during a time when the sheet material passes through a nip portion of the discharge roller and be restored after the sheet material passes therethrough, thereby capable of being engaged with a rear end of the sheet material. Accordingly, it is possible to push the sheet material so as to discharge by a simple structure that the protrusion is only provided on the peripheral surface of the body portion of the roller-shaped profiling pusher. Further, in the case of providing the profiling pusher in the discharge roller side in the lower side of the path line, since the protrusion of the profiling pusher downward urges the rear end of the sheet material while pushing, there can be obtained an effect that the sheet material can be quickly recovered in the tray side for a short time without floating up.

In accordance with a third aspect of the present invention, there is provided a discharge mechanism of a sheet material in an image forming apparatus as recited in the second aspect, wherein the body portion and the protrusion of the profiling pusher are integrally formed by a sponge obtained by foaming a polyurethane, and the protrusion has a cross sectional shape tapered toward a front end side thereof. Accordingly, since the body portion is made smaller than the paper discharge roller although being made of a sponge, an expanding deformation due to a centrifugal force at a rotating time can be restricted, it is possible to loosen the pushing force against the sheet material by the protrusion, and there can be achieved an effect that a profiling deformation can be easily obtained when the sheet material passes therethrough by forming the protrusion in the tapered cross sectional shape.

BRIEF DESCRIPTION OF THE DRAWINGS

FIGS. 4A and 4B are views showing details of a profiling pusher, in which FIG. 4A is a vertical cross sectional view as cut along a surface including an axis and FIG. 4B is a front elevational view as seen in an axial direction;

DESCRIPTION OF THE PREFERRED EMBODIMENT

A description will be given below of an embodiment in accordance with the present invention with reference to the accompanying drawings.

Figure 1:
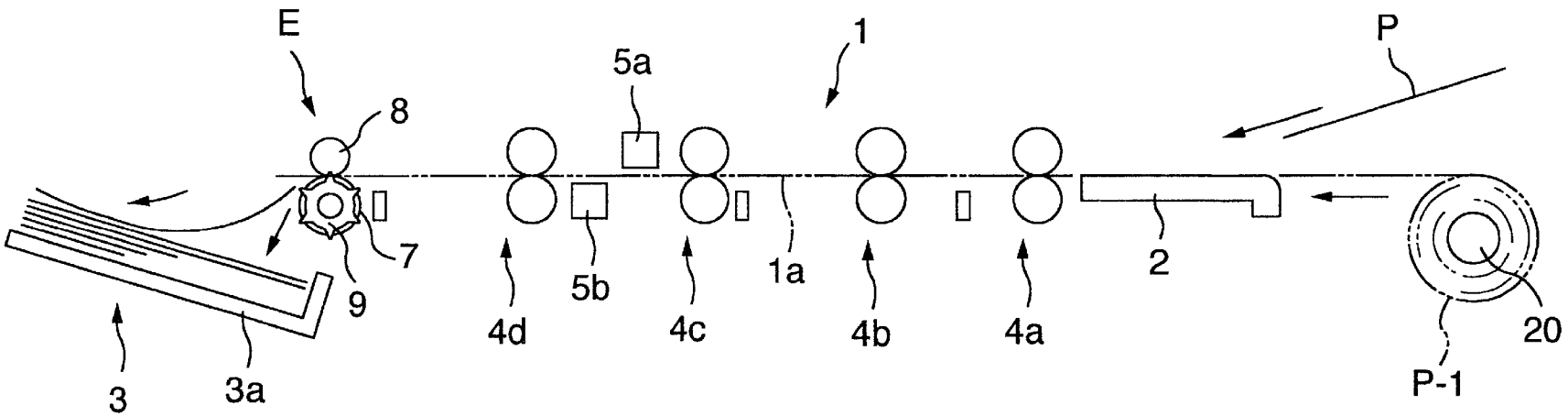
FIG. 1 is a schematic view showing a scanner for reading an image provided with a discharge mechanism in accordance with the present invention, and transfer and image reading systems from a paper supply table to a recovering tray.

FIG. 1 is a schematic view showing a scanner for reading an image provided with a discharge mechanism in accordance with the present invention, and transfer and image reading systems from a paper supply table to a recovering tray. In this case, in the embodiment in accordance with the present invention, a description will be given of an example of setting a manuscript paper of A0 size or larger to a sheet material.

A scanner shown in FIG. 1 is structured such that a paper transfer path 1 provided with an image reading portion therewithin is formed. Further, a paper supply table 2 for manually mounting and feeding one paper P or releasing a paper P-1 wound like a roll from a reel stand 20 so as to supply is arranged in a start end of the transfer path 1. Further, a tray 3 for mounting the paper P or P-1 after the image is read so as to recover is arranged in a terminal end of the transfer path 1.

Pairs of transfer rollers 4*a*, 4*b*, 4*c* and 4*d* are subsequently arranged in the horizontal transfer path 1 extending from the paper supply table 2 toward the tray 3 side so as to be disposed in this order from an upstream side toward a downstream side. Each of these pairs of rollers 4*a* to 4*d* is constituted by a combination of a pair of rollers arranged in such a manner as to vertically hold a path line 1*a* of the paper therebetween, and is structured, for example, such that a roller arranged in a lower side is driven and a roller arranged in an upper side is an idler. Further, all of the pairs of transfer rollers 4*a* to 4*d* synchronously rotate at the same peripheral speed so as to transfer the paper nipped between the rollers to the downstream side at a fixed speed.

Scanning heads 5*a* and 5*b* for reading the image on the paper are respectively arranged in upper and lower portions of the path line 1*a* between two pairs of transfer rollers 4*c* and 4*b*. The scanning heads 5*a* and 5*b* respectively scan the image on the upper surface and the lower surface in an optical manner when the paper P or P-1 is transferred, and input scanning signals to an image processing portion (not shown).

The tray 3 is arranged in the lower side of the pass line 1*a* in correspondence to the position of the terminal end of the transfer path 1 and is structured such as to arrange a bottom 3*a* for mounting the paper P or P-1 in an obliquely upward attitude. Further, a discharge mechanism E for discharging the paper P or P-1 from the path line 1*a* toward the tray 3 is positioned substantially immediately above a base end side of the tray 3.

Figure 2:
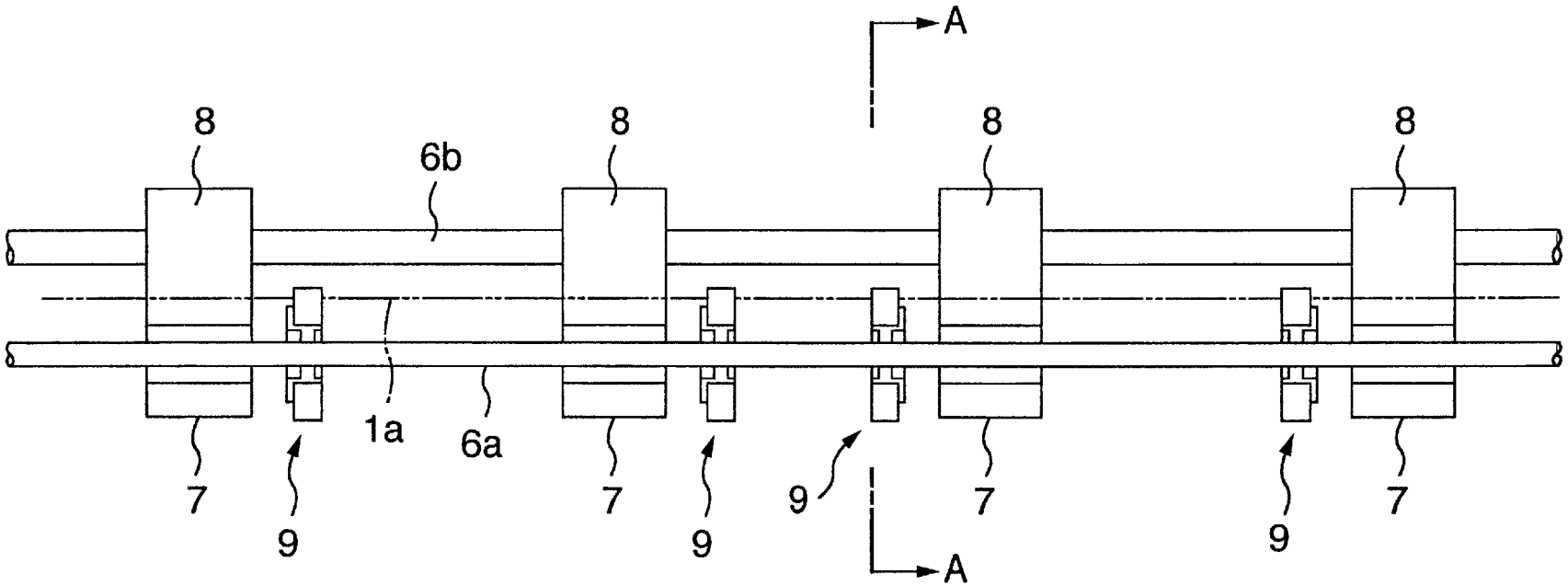
FIG. 2 is a front elevational view of a discharge mechanism as seen from an upstream side of a path line.
Figure 3:
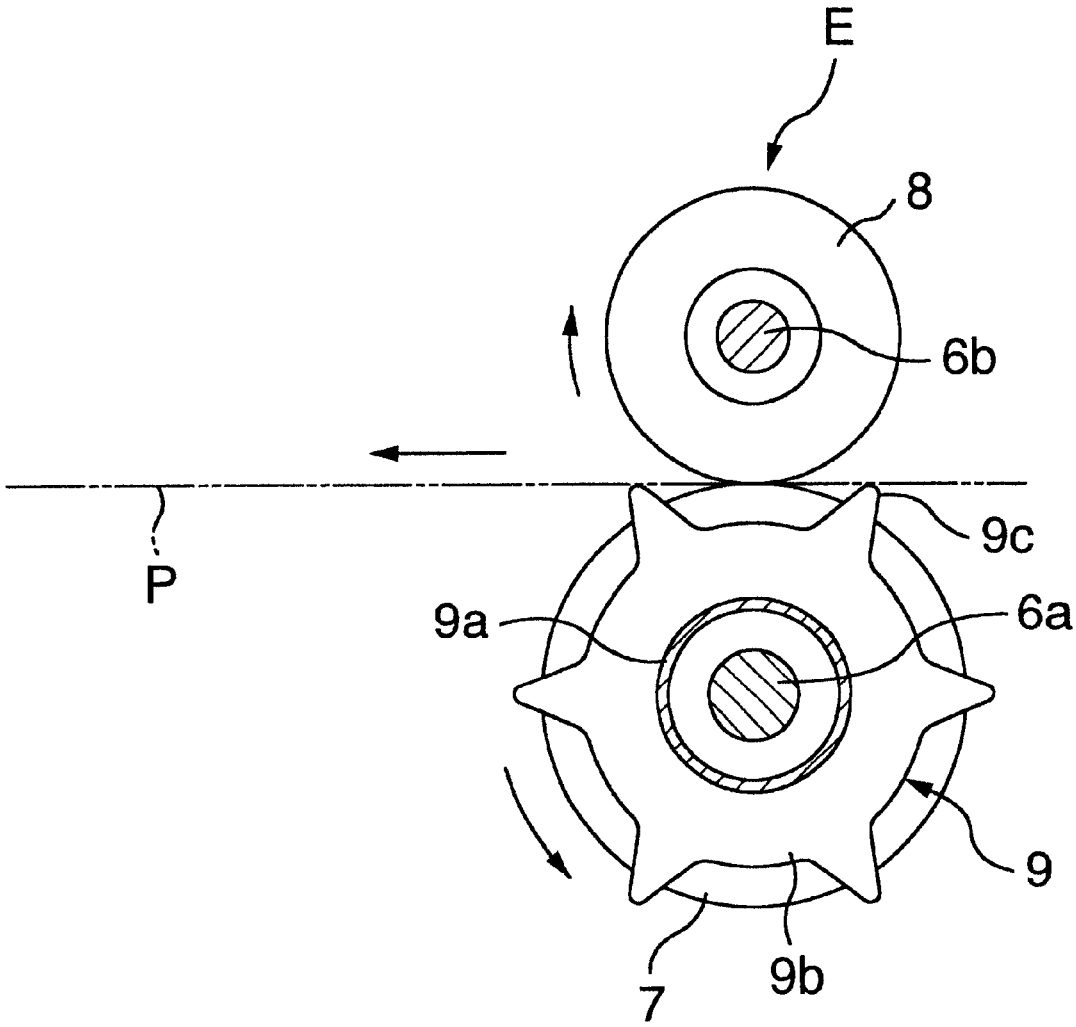
FIG. 3 is a cross sectional view as seen along a line A—A in FIG. 2.

FIG. 2 is a front elevational view of the discharge mechanism E as seen from an upstream side of the path line 1*a* and FIG. 3 is a cross sectional view as seen along a line A—A in FIG. 2.

The discharge mechanism E is constituted by discharge rollers 7 and 8 respectively mounted to a driven rotational shaft 6*a* disposed in a lower side of the path lint 1*a*and a non-driven rotational shaft 6*b* disposed in an upper side of the path line 1*a*, and a profiling pusher 9 mounted to the driven rotational shaft 6*a*. The driven rotational shaft 6*a* is included in a drive system of the pairs of transfer rollers 4*a* to 4*d* and rotates at such rotational speed that a peripheral speed of the discharge roller 7 is the same as that of the pairs of transfer rollers 4*a* to 4*d*. Further, the pairs of discharge rollers 7 and 8 are arranged as shown in FIG. 3 so as to satisfy such positional relation as to include a nip portion in the path line 1*a*, and when the discharge roller 7 is rotated and driven in a direction of an arrow in FIG. 3, the discharge roller 8 rotates in a direction of an arrow in FIG. 3 due to a friction obtained at a time when the paper P is nipped.

Figure 4A:
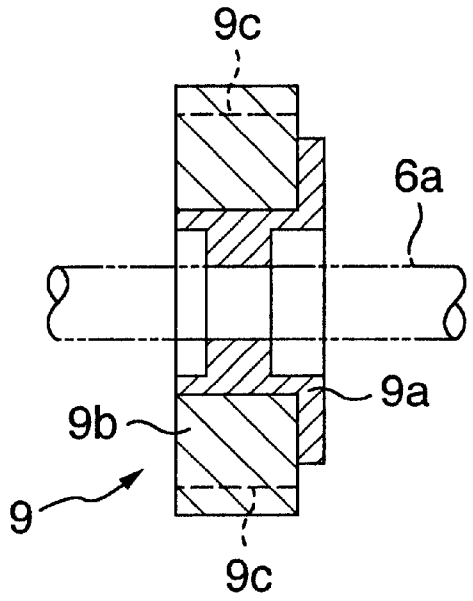
Figure 4B:
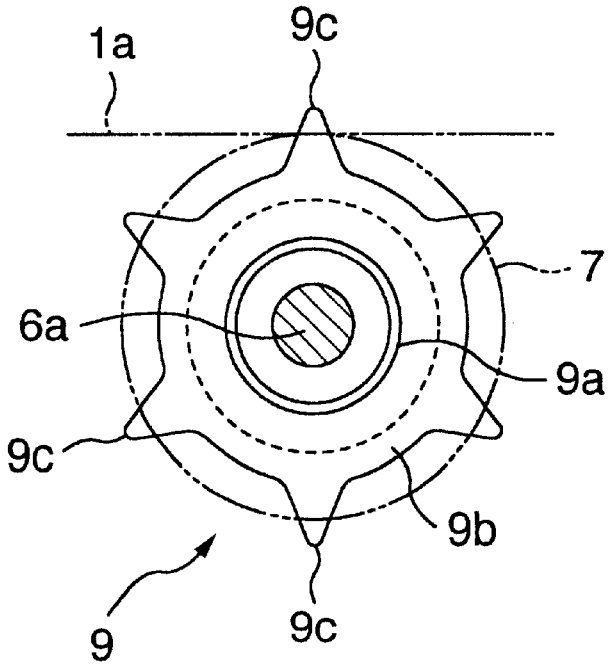

FIGS. 4A and 4B are views showing details of the profiling pusher 9, in which FIG. 4A is a vertical cross sectional view as cut along a surface including an axis and FIG. 4B is a front elevational view as seen in an axial direction.

The profiling pusher 9 is constituted by a metal boss 9*a* for being fixed to the driven rotational shaft 6*a*, a body portion 9*b* integrally bonded to a peripheral surface thereof and a plurality of projections 9*c* formed on a peripheral surface of the body portion 9*b*. The body portion 9*b* and the projections 9*c* are integrally formed by using, for example, a material obtained by foaming a polyurethane so as to form a sponge like, and the structure is made such that the body portion 9*b* is outward fitted to an outer periphery of the boss 9*a* so as to be bonded. The body portion 9*b* is about half smaller than an outer diameter of the discharge roller 7 coaxially arranged with the profiling pusher 9, as shown in FIG. 4B. Further, the projections 9*c* are arranged at six portions on the outer peripheral surface of the body portion 9*b* at a fixed circumferential pitch and are formed in a cross sectional shape tapered in a radial direction. A radius of these projections 9*c* between a center and a tip end of the projection is set to be a little longer than a radius of the coaxially arranged discharge roller 7, as is apparent from FIG. 4B. Accordingly, the projection 9*c* keeps a shape protruding upward from the path line 1*a* shown by a single dot chain line in FIG. 4B when no external force is applied thereto and no compression and no bent deformation are generated.

The profiling pusher 9 having the structure mentioned above is arranged near four discharge rollers 7 fixed to the driven rotational shaft 6*a*, as shown in FIG. 2, and opposes to the transferred paper at four portions.

In the structure mentioned above, the paper P manually set to the paper supply table 2 in FIG. 1 is transferred downstream after being nipped by the pair of transfer rollers 4*a*, and is subsequently transferred to the pairs of transfer rollers 4*b*, 4*c* and 4*d* so as to be fed. Further, the image on the paper P is read by both or any one of the scanning heads 5*a* and 5*b* during this feeding, and the paper P is discharged toward the tray 3 by the discharge mechanism E. In this case, the long paper P-1 wound around the reel stand 20 is processed in the same manner.

Since the paper P is nipped by the discharge rollers 7 and 8 as shown in FIG. 3 when the paper P passes through the discharge mechanism E, the paper P is fed by a rotation of the discharge roller 7 in the drive side and an accompanied rotation of the discharge roller 8 due to a friction with respect to the paper P until the rear end thereof passes therethrough. On the contrary, since the profiling pusher 9 fixed to the driven rotational shaft 6*a* integrally rotates, the projection 9*c* having a protruding length over the path line 1*a* when no load is applied is brought into contact with the lower surface of the paper P so as to be deformed in a profiling manner.

Figure 5:
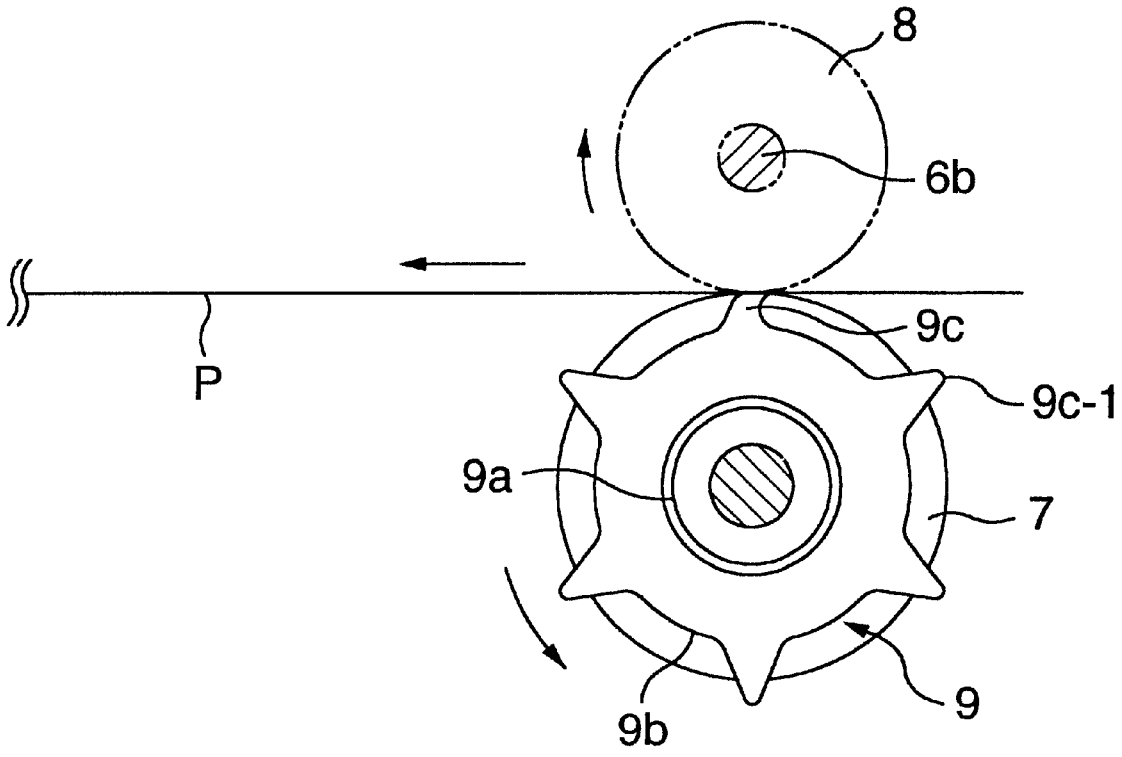
FIG. 5 is a view showing a state that a paper is nipped between discharge rollers and a protrusion of a profiling pusher is deformed in a profiling manner.

FIG. 5 shows the profiling deformation of the projection 9*c*. When the paper P is nipped between the discharge rollers 7 and 8, the projection 9*c* is bent in a direction opposite to the rotational direction due to the rotation of the profiling pusher 9 and is deformed in a profiling manner with respect to the lower surface of the paper P. That is, since the body portion 9*b* and the projection 9*c* of the profiling pusher 9 are formed in a sponge like, the body portion 9*b* and the projection 9*c* are elastically deformed at a moment even against a small external force, does not operate as a resistance against the feeding of the paper P during a period being contact with the paper P and applies a small load to the paper P, so that there is no deformation so as to recess the paper P upward from the lower surface thereof.

Here, in the case of setting the outer diameter of the body portion 9*b* of the profiling pusher 9 slightly smaller than the discharge roller 8 so as to reduce the protruding length of the projection 9*c*, the pressing force against the paper P by the projection 9*c* is increased and the recess deformation is easily generated. That is, since the driven rotational shaft 6*a* rotates, for example, at about 60 rpm, the outer diameter of the body portion 9*b* is increased due to a centrifugal force. Since a rate of the outer diameter change is substantially proportional to the outer diameter of the body portion 9*b*, the deformation degree is increased in accordance with an increase of the outer diameter of the body portion 9*b*. Accordingly, when the profiling pusher 9 is formed so that the outer diameter of the body portion 9*b* is slightly smaller than the discharge roller 7 and the distance between the outer peripheral surface thereof and the path line 1*a* is short, the pressing force against the paper P by the projection 9*c* is increased, so that the recess deformation is generated on the paper P.

On the contrary, in the case of setting the outer diameter of the discharge roller 7 to about 50 mm, when the outer diameter of the body portion 9*b* of the profiling pusher 9 is set to about 40 mm and an outer diameter of an imaginary circle described by the tip end of the projection 9*c* is set to about 51 mm, it is possible to reduce the change of the outer diameter due to an expansion of the body portion 9*b* caused by a centrifugal force. That is, since an amount of deformation of the body portion 9*b* due to the centrifugal force is reduce d by making a thickness of the body portion 9*b* in a radial direction small, the pressing force against the paper P by the projection 9*c* is reduced, so that it is possible to prevent the recess deformation from being generated. Accordingly, even in the case that the distance between the discharge mechanism E and the scanning heads 5*a* and 5*b* is short, the recess deformation does not expand to the portion where the paper P is scanned, and a reduction of an accuracy of reading the image of the paper P is not caused.

The paper P is transferred to a downstream portion by the nip of the discharge rollers 7 and 8 while deforming the projection 9*c* of the profiling pusher 9 in a profiling manner as mentioned above, and the rear end of the paper P moves apart from the projection 9*c* substantially at the same time as the removal from the nip. Accordingly, since no load is applied to the projection 9*c* from the paper P, the profiling deformation is restored to the tapered cross sectional shape as shown in FIG. 6 and the protrusion to the tip end becomes long.

On the contrary, the paper P to which no nip force of the discharge rollers 7 and 8 is applied is fed to the tray 3 side in accordance with an application of the feeding force of the discharge rollers 7 and 8. The paper P is fed out due to the feeding force of the discharge rollers 7 and 8 and an inertia of the paper P itself. However, when the paper P is significantly thin, lacks firmness and has a long size, a rigidity thereof becomes very small, so that the feeding force of the discharge rollers 7 and 8 is absorbed by the paper P itself and the paper P is unstably fed out. Further, even when the paper P is a long material, mass thereof is not so great, so that an inertia force is significantly small and does not stably contribute to the feeding of the paper P. Accordingly, there is a case that when the paper P moves out from the nip of the discharge rollers 7 and 8, the paper P stops the position and can not be recovered in the tray 3. Further, there is a case that the rear end of the paper P stops in a state of being nipped between the discharge rollers 7 and 8 due to some reasons.

Figure 6:
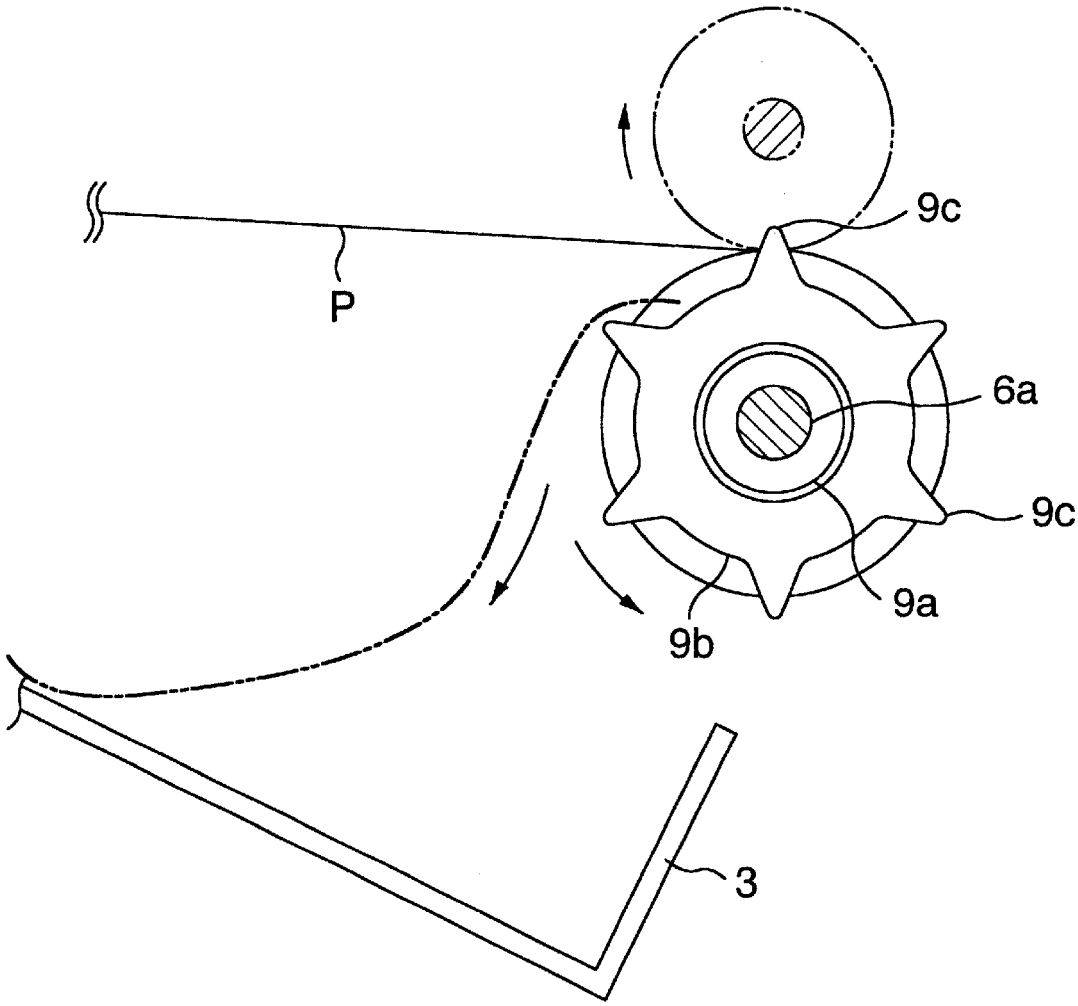
FIG. 6 is a view showing a state that a paper is pushed out toward a tray by a restored protrusion.
Figure 7:
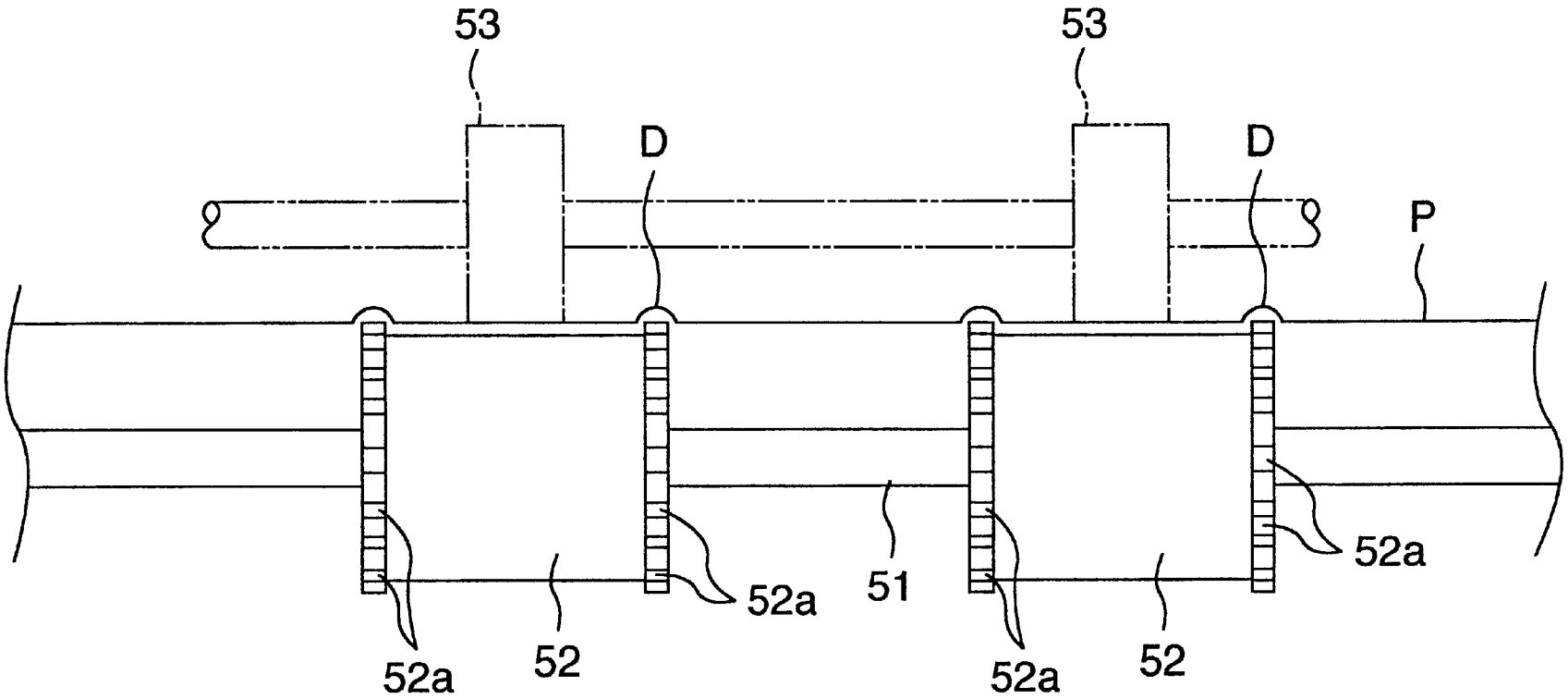
FIG. 7 is a schematic view showing a main portion of a conventional art.

On the contrary, as shown in FIG. 6, the rear end of the paper P goes out of the nip between the discharge rollers 7 and 8, the pusher 9*c* of the profiling pusher 9 is restored. Then, since the profiling pusher 9 continuously rotates, the restored projection 9*c* pushes the rear end of the paper P immediately after going out of the nip between the discharge rollers 7 and 8. Accordingly, even when the paper P stops immediately after going out of the nip between the discharge rollers 7 and 8, the paper P is forcibly pushed out from the rear end side by the projection 9*c* of the profiling pusher 9 so as to be securely discharged toward the tray 3.

Further, when the rear end of the paper P stops in a state of being nipped between the discharge rollers 7 and 8, the projection 9*c* deformed in a profiling manner at a time of being nipped is brought into contact with the lower surface of the paper P, so that the projection 9*c* is restored after going out of the below of the deformed paper P. Then, a projection 9*c*-1 adjacent to the projection 9*c* deformed in a profiling manner (a projection one pitch shifted in a clockwise direction from the projection 9*c* deformed in a profiling manner in FIG. 5) moves to the rear end side of the paper P due to the rotation of the profiling pusher 9 so as to push the paper P. Accordingly, the paper P in a nipped state is forcibly pushed out by the projection 9*c*-1 so as to be discharged to the tray 3.

Here, even in the case that the paper P can not be pushed out by one projection in any one of states that the rear end of the paper P stops immediately after going out of the nip or is nipped, six projections 9*c* are successively brought into contact with the rear end of the paper P due to the rotation of the profiling pusher 9. Accordingly, it is possible to feed out the paper P before the front end of the next paper reaches and no paper jamming is generated.

Further, in FIG. 6, the restored projection 9*c* after passing the nip portion between the discharge rollers 7 and 8 moves downward due to the rotation of the profiling pusher 9. Accordingly, the paper P pushed at the rear end is pushed to a lower side in accordance with a movement of the projection 9*c*, and at the same time, the front end side of the paper P is bent to the tray 3 side due to an empty weight of the paper. Therefore, the paper P is thrown in a direction of a single dot chain arrow in FIG. 6 and the rear end side of the paper P can be recovered in the tray 3 for a short time without floating up. Since it is possible to reduce a feeding time of the paper P to the tray 3 as mentioned above, it is possible to more securely prevent the paper jamming from being generated while preventing the front end of the following paper P is not brought into contact with the paper P going to be recovered in the tray 3, if the manuscript paper P is supplied at a slight interval.

In this case, in the embodiment mentioned above, the description will be given of the scanner apparatus, however, it is a matter of course that the present invention can be applied to a paper discharge mechanism provided in a paper discharge end in an automatic paper supply apparatus such as a copying machine, a printer or the like.

In accordance with the present invention, since the discharging means for pushing the rear end of the sheet material so as to forcibly push out to the tray side is provided in addition to the discharge rollers for nipping the sheet material so as to apply the feeding force, it is possible to securely discharge the sheet material to the tray by the discharging means even when the rear end of the sheet material is nipped between the discharge rollers or stops immediately downstream the nip portion. Accordingly, an operation of manually removing the sheet material is not at all required, the following sheet material is not brought into contact with the rear end of the preceding sheet material even when the sheet materials are continuously supplied, and it is possible to prevent the jamming from being generated.

Further, when the structure is made such that the discharging means is set to a profiling pusher integrally rotating with the discharge rollers and the profiling pusher is arranged in the lower side of the path line, the projection of the profiling pusher presses down the sheet material successively after pushing out the rear end of the sheet material. Accordingly, since the sheet material is quickly dropped down into the tray without being floated up, it is possible to stably recover the long sheet material to the tray side.

What is claimed is:

1. An image forming apparatus comprising:

structure providing a transfer path to which said sheet material is supplied;

an image processing apparatus for reading an image from said sheet material or printing an image on said sheet material, said image processing apparatus being arranged in the middle of said transfer path;

a tray arranged at one side of a terminal end of said transfer path for recovering said sheet material; and a discharge mechanism for discharging said sheet material to said tray, said discharge mechanism being provided at said terminal end of said transfer path and including:

(a) a pair of discharge rollers arranged (i) at opposite sides of a path line of said sheet material so that at least one of said pair of discharge rollers can be driven, and (ii) to provide a nip portion to nip said sheet material so as to apply a transfer movement; and (b) discharging means operating to interlock with one of said discharge rollers, for forcibly pushing a trailing end of said sheet material to discharge said sheet material to said tray, wherein:

said discharging means comprises a roller-shaped profiling pusher coaxially connected to at least one of said pair of discharge rollers, said profiling pusher includes (i) a body portion, which has a smaller outer diameter than an outer diameter of said at least one of said pair of discharge rollers and (ii) a protrusion positioned on an outer peripheral surface of said body portion, and said protrusion has a uniform cross section in an axial direction of said pair of rollers and a height crossing said path line when said pair of rollers nip said sheet material, and said protrusion for being (i) elastically deformed in a profiling manner due to a reaction force from said sheet material during a time when said sheet material passes through said nip portion of said pair of discharge rollers, and (ii) restored after said sheet material passes through said nip portion and to enable the protrusion to be engaged with a rear end of said sheet material.

2. An image forming apparatus as claimed in claim 1, wherein the body portion and the protrusion of said profiling pusher are integrally formed by a sponge obtained by foaming a polyurethane, and said protrusion has a cross sectional shape tapered toward an outer end thereof.

3. An image forming apparatus comprising:

structure providing a transfer path to which said sheet material is supplied;

an image processing apparatus that is operable to read an image from said sheet material or to print an image on said sheet material, said image processing apparatus being arranged in the middle of said transfer paths;

a tray arranged at one side of a terminal end of said transfer path that is operable to recover said sheet material; and a discharge mechanism that is operable to discharge said sheet material to said tray, said discharge mechanism being provided at said terminal end of said transfer path and including:

(a) a pair of discharge rollers arranged (i) at opposite sides of a path line of said sheet material so that at least one of said pair of discharge rollers can be driven, and (ii) to provide a nip portion to nip said sheet material so as to apply a transfer movement; and (b) a discharge device that is operable to interlock with one of said discharge rollers, to forcibly push a trailing end of said sheet material to discharge said sheet material to said tray, wherein:

said discharge device comprises a roller-shaped profiling pusher coaxially connected to at least one of said pair of discharge rollers, said profiling pusher includes (i) a body portion, which has a smaller outer diameter than an outer diameter of said at least one of said pair of discharge rollers and (ii) a protrusion positioned on an outer peripheral surface of said body portion, and said protrusion has a uniform cross section in an axial direction of said pair of rollers and a height crossing said path line when said pair of rollers nip said sheet material, and said protrusion being capable of being (i) elastically deformed in a profiling manner due to a reaction force from said sheet material during a time when said sheet material passes through said nip portion of said pair of discharge rollers, and (ii) restored after said sheet material passes through said nip portion and to enable the protrusion to be engaged with a rear end of said sheet material.

4. An image forming apparatus as claimed in claim 3, wherein the body portion and the protrusion of said profiling pusher are integrally formed by a sponge obtained by foaming a polyurethane, and said protrusion has a cross sectional shape tapered toward an outer end thereof.

* * * * *